US006945723B1

(12) United States Patent
Gueret

(10) Patent No.: US 6,945,723 B1
(45) Date of Patent: Sep. 20, 2005

(54) PACKAGING AND APPLICATION DEVICE

(75) Inventor: Jean-Louis Gueret, Paris (FR)

(73) Assignee: L'Oréal, Paris (FR)

( * ) Notice: Subject to any disclaimer, the term of this patent is extended or adjusted under 35 U.S.C. 154(b) by 533 days.

(21) Appl. No.: 09/666,450

(22) Filed: Sep. 21, 2000

(51) Int. Cl.[7] ..... A45D 33/00

(52) U.S. Cl. ..... 401/130; 401/124; 401/125; 401/122

(58) Field of Search ..... 401/118, 206, 401/126, 130, 129, 128, 127, 123, 124, 183, 184, 185, 22, 23, 25, 36, 37; 222/205, 206, 207, 195, 214, 213, 212; 132/294, 293, 300

(56) References Cited

U.S. PATENT DOCUMENTS

| | | | | | |
|---|---|---|---|---|---|
| 1,021,709 | A | * | 3/1912 | Snow | 401/129 |
| 1,056,457 | A | * | 3/1913 | Schloss | 401/34 |
| 1,063,484 | A | * | 6/1913 | Weismantel | 401/102 |
| 1,172,293 | A | * | 2/1916 | Kohlhepp | 401/102 |
| 1,450,386 | A | * | 4/1923 | Regan | 401/130 |
| 2,069,048 | A | * | 1/1937 | Rehberger | 222/205 |
| 2,554,489 | A | * | 5/1951 | Crane | 401/125 |
| 2,691,184 | A | * | 10/1954 | Miller et al. | 401/36 |
| 3,456,650 | A | * | 7/1969 | Schwartzman | 604/298 |
| 3,456,851 | A | * | 7/1969 | Mattes et al. | 222/205 |
| 3,592,365 | A | * | 7/1971 | Schwartzman | 222/209 |
| 3,682,558 | A | * | 8/1972 | Miller | 222/189.02 |
| 4,693,623 | A | * | 9/1987 | Schwartzmann | 401/206 |
| 4,780,071 | A | * | 10/1988 | Bradford | 401/123 |
| 4,832,060 | A | * | 5/1989 | Kingsford | 132/293 |
| 4,925,327 | A | * | 5/1990 | Wirt | 401/205 |
| 4,929,108 | A | | 5/1990 | Gueret | |
| 4,974,981 | A | * | 12/1990 | Bennett | 401/123 |
| 5,492,426 | A | | 2/1996 | Gueret | |
| 5,636,931 | A | | 6/1997 | Gueret | |
| 5,945,076 | A | * | 8/1999 | Loenard et al. | 422/300 |

FOREIGN PATENT DOCUMENTS

| | | | | |
|---|---|---|---|---|
| DE | 938658 | | 2/1956 | |
| DE | 406 544 | | 8/1966 | |
| DE | 2132433 | * | 1/1973 | 401/123 |
| EP | 163189 A | * | 12/1985 | 401/123 |
| EP | 0 416 185 A1 | | 3/1991 | |
| EP | 0 416 186 A2 | | 3/1991 | |

(Continued)

OTHER PUBLICATIONS

English Translation of DE 406 544.
English language translation of DE 2 132 433.

*Primary Examiner*—Gregory Huson
*Assistant Examiner*—Huyen Le
(74) *Attorney, Agent, or Firm*—Finnegan Henderson Farabow Garrett & Dunner, L.L.P.

(57) ABSTRACT

Packaging and application device comprising a container having an internal space (12) in which the product (P) is contained, an application element (16), a housing (14) for housing the application element and a permeable wall (23) placed between the said housing and the internal space containing the product.

The application element and the housing are both designed in such a way that the application element has, when it is in the said housing, at least one surface portion **(16*a*) located, without any appreciable axial compression, opposite an opening (25)** in the permeable wall.

The internal space is a variable-volume space, compression means being provided for making the said internal volume pass selectively from a first volume, greater than the volume of product, to a second volume, smaller than the first, this reduction in volume being accompanied by an overpressure which is conducive to transferring product through the said permeable wall towards the application element.

141 Claims, 9 Drawing Sheets

FOREIGN PATENT DOCUMENTS

| | | | |
|---|---|---|---|
| EP | 0 612 488 | A1 | 8/1994 |
| EP | 0 688 516 | A1 | 12/1995 |
| EP | 0 855 177 | A2 | 7/1998 |
| GB | 403219 | | 12/1933 |
| GB | 1158412 | | 7/1999 |
| JP | U 64-39879 | | 3/1989 |
| JP | A 2-98306 | | 4/1990 |
| JP | U 03-57089 | | 5/1991 |
| JP | U 6-3473 | | 1/1994 |
| JP | A 6-296520 | | 10/1994 |
| JP | A 7-313247 | | 12/1995 |

* cited by examiner

PACKAGING AND APPLICATION DEVICE

PACKAGING AND APPLICATION DEVICE

The present invention relates to a device for packaging and applying a product, especially a cosmetic or beauty care product, comprising a container having an internal space in which the product is contained, an application element, a housing for housing the application element and a permeable wall placed between said housing and the internal space containing the product.

British Patent GB 403,219 discloses a device of this type, in which the product is a powder contained inside the container between the permeable wall and a perforated bottom. In use, the user injects air under the powder by virtue of the perforated bottom. The powder is sprayed into the internal space and reaches, through the permeable wall, the application element.

Such a device can be used only with a powder and it has a relatively complex structure.

European Patent Application EP-A-0,612,488 discloses a device in which the application element is deformable and the housing has a capillary end-piece pierced by at least one orifice, against which the application element is applied and deformed when the container is closed. When the container is opened, the application element resumes its initial shape and creates a sucker effect which sucks up the product.

European Patent Application EP-A-0,688,516 discloses a perforated-piston application device comprising a resilient means for ensuring pressure of the application element on the piston.

European Patent Application EP-A-0,416,185 discloses a lipstick applicator comprising an internal space containing the product and means for extruding this product into a housing containing the application element. The product entirely fills the internal space, in the compacted state.

Patents GB 1,158,412 and DE 938,658 disclose devices comprising a malleable tube without any shape memory, defining an internal space the volume of which corresponds to that of the product and decreases at each use.

There is a need for having available a novel packaging and application device, of relatively simple structure, allowing an application element to be easily filled with product, this product possibly being a powder, a liquid, a gel or a cream.

The packaging and application device according to the invention is of the type comprising a container having an internal space in which the product is contained, an application element, a housing for housing the application element and a permeable wall placed between said housing and the internal space containing the product.

This device is characterized in that the application element and the housing are both designed in such a way that the application element has, when it is in said housing, at least one surface portion located, without any appreciable axial compression, opposite an opening in the permeable wall and in that the internal space is a variable-volume space, compression means being provided for making said internal volume pass selectively from a first volume, greater than the volume of product, to a second volume, smaller than the first, this reduction in volume being accompanied by an overpressure which is conducive to transferring product through said permeable wall towards the application element.

Advantageously, the compression means are designed so that the internal space resumes its first volume under the action of an elastic return force.

The elastic return force may be obtained by virtue of the fact that the container has shape memory, being preferably made of plastic.

The elastic return force may also be obtained by means of a spring, especially a helical spring.

The device according to the invention has many advantages.

First of all, the presence of air in the container prevents the reserve of product being compacted when the internal space occupies its second volume, unlike the device described in Application EP-A-0,416,186 for example.

Moreover, the device according to the invention may be of simpler construction than that described in the aforementioned British Patent GB 403,219, since the product may be contained in the internal space of the container without having to provide a perforated bottom allowing air to be injected.

The absence of axial compression of that surface portion of the application element which is located opposite the permeable wall allows the product to be able to pass through the latter easily, when the overpressure is created.

Advantageously, the device includes retention means on and/or adjacent to the permeable wall, on that side of the internal space containing the product, these retention means being suitable for favouring, especially by a capillary effect or by electrostatic attraction, the retention of product in said opening or in its vicinity, for the purpose of transferring it into said housing during the compression of a volume of air present in the internal space, between the permeable wall and the reserve of product.

Thus, the device may be placed with the top uppermost at the moment when the overpressure is created and/or when the application element is removed from its housing, which arrangement provides for easy use.

In addition, it is possible to design the retention means so as to control the dispensing of the product, especially by preventing an excess of product reaching the housing of the application element during use.

In one particular embodiment, the container has a moveable wall allowing said overpressure to be generated.

This moveable wall may comprise a flexible wall of the container, for example a flexible wall in the form of a bellows, which wall is relatively inexpensive to produce.

As a variant, the moveable wall may comprise a rigid wall of a piston.

The compression means allowing the overpressure to be created may be designed to assist in the delivery of a predetermined amount of product at each use, allowing the user to exert, each time, a predetermined overpressure in the internal space of the container.

In one particular embodiment, the permeable wall has a plurality of through-orifices.

The aforementioned retention means may include partitions between which the product can be retained.

The retention means may also include a retention member placed opposite the permeable wall, this retention member having lateral openings allowing the product to reach a product retention space provided between the retention member and the permeable wall.

This retention member may also constitute a deflector designed to channel a stream of air and/or product when the overpressure is created, for the purpose of favouring transfer of the product through the permeable wall.

The retention means may be produced by moulding or, as a variant, may consist of an attached piece, such as a block of foam for example.

The nature of the retention means will be chosen depending on that of the product and on the amount to be dispensed.

In one particular embodiment, the application element and the housing are designed in such a way that the surface of the application element serving for applying the product is kept away from the permeable wall, when the application element is in place in the said housing.

Product may thus accumulate more easily in the space formed between the permeable wall and the application element.

So as to facilitate the creation of such a space, the permeable wall may include at least one rib on the same side as the application element, against which the application element is able to bear.

The permeable wall may also be joined to the container via a shoulder forming a cup on the same side as the application element.

As a variant, the application element and the housing are designed in such a way that the surface of the application element serving for applying the product is in contact with the permeable wall, when the application element is in place in the said housing.

The application element may be designed in such a way that the surface of the application element located, when the application element is in place in the said housing, opposite the permeable wall, can move back under the effect of the overpressure in the container.

Thus, this surface may be easily filled with product.

In one particular embodiment, the housing is bounded by a side, preferably solid, wall against which the application element is applied via its periphery.

Preferably, the application element is applied in a sealed manner against the said side wall.

The application element may behave as a piston during its retraction, for example over a travel of 4 mm, thus creating a depression in its housing.

Again in one particular embodiment, the container is designed in such a way that when the internal space has its second volume, the level of product in the container does not reach the permeable wall.

If the product is a liquid, any risk of its spillage is thus avoided.

In one particular embodiment, the permeable wall defines the bottom of the housing which houses the application element, the latter being introduced into the said housing via an opening located on the axis of the container, on the opposite side from said permeable wall.

Again in one particular embodiment, the permeable wall includes channels, the cross section and the length of which are chosen so as to make it possible to accommodate a predetermined amount of product and/or to let the latter flow through them.

It is thus possible to meter the amount of product reaching the said housing when the overpressure is exerted.

The application element may advantageously be integral with a gripping element which also constitutes a cap for closing the container.

The gripping element may include sealing means for sealing the housing which houses the application element.

The permeable wall may be produced by moulding with the container or an element of the latter.

As a variant, the permeable wall may consist of a piece attached to the container.

The permeable wall may comprise a mesh or a foam.

In one particular embodiment, the permeable wall is largely plane.

As a variant, it may, for example, be concave towards the opening in the housing.

In a particular embodiment, the permeable wall has a shape complementary to that of the application element.

Again in a particular embodiment, the permeable wall has substantially radial or axial orifices.

The permeable wall may consist in particular of a woven, a perforated plastic film or a welded or overmoulded screen.

In one particular embodiment, the permeable wall is immovably fixed around its periphery to the container.

Again in a particular embodiment, the application element is absorbent, being made from a material such as a foam, a felt or a sintered material.

Again in one particular embodiment, the application element is elastically compressible. As a variant, the application element may be substantially incompressible.

The application element may be non-porous on the inside.

In one particular embodiment, the application element is flocked or has a textile on its surface.

The housing which receives the application element can move with respect to the internal space in the container containing the product.

The device may include a second application element, a second housing and a second permeable wall.

The second application element may be of the same kind as the first application element, but of different size.

The first and second application elements may also not be of the same kind.

The container may include a neck closed off by a removeable stopper at an end located on the opposite side from the application element.

The product may be at least partly formed from particles containing at least one fluid, the latter being contained, for example, in microcapsules.

Compositions containing such particles exhibit excellent cosmetic properties, being capable of adhering sufficiently but not excessively to skin, the said particles being very soft and easily applied.

During application to the skin, the pressure exerted by the application element on the skin releases the liquid, which gives a pleasant feeling of freshness and softness.

Such compositions may include a pulverulent phase comprising pigments and/or nacres and/or fillers and/or flakes and/or mixtures thereof.

The aforementioned pigments are advantageously selected from titanium, zirconium or cerium dioxides, zinc, iron or chromium oxide, titanium nanoparticles, zinc nanoparticles, ferric blue, carbon black, lacquers such as calcium, barium, aluminium or zirconium salts, acid dyes such as halo-acid, azo or anthraquinone dyes, and pigments coated with silicone compounds, such as polydimethylsiloxanes, and/or with polymers, especially polyethylenes.

The aforementioned fillers are advantageously selected from talc, mica, silica, kaolin, nylon, poly-β-alanine and polyethylene powders, Teflon, lauroyl lysine, starch, boron nitride, bismuth oxychloride, tetrafluoroethylene polymer powders, polymethyl methacrylate powders, polyurethane powders, polystyrene powders and polyester powders, synthetic hollow microspheres, silicone-resin microbeads and microsponges, zinc and titanium oxides, zirconium or cerium oxides, precipitated calcium carbonate, magnesium carbonate and hydrogencarbonate, hydroxyapatite, hollow silica microspheres, glass or ceramic microcapsules and metal soaps derived from carboxylic organic acids having from 8 to 22 carbon atoms, preferably from 12 to 18 carbon atoms, for example zinc, magnesium or lithium stearate, zinc laurate and magnesium myristate.

The fluid contained in the said particles is, for example, in aqueous or oily form, especially in the form of essential oils, a gel, a water-in-oil emulsion or an oil-in-water emulsion.

The fluid may be contained in porous waxes, in vesicles or microcapsules, the walls of which are especially made of epoxy, of polyethylene, of gelatin or of polyester, or in microsponges or microspheres.

The product may contain at least one active agent, especially antioxidants or free-radical scavengers, hydrating or moisturizing agents, UV screens, keratolytics, tanning accelerators, depigmentizing agents, natural colorants, self-tanning agents, liporegulators, anti-ageing and anti-wrinkle agents, anti-inflammatory and cicatrizing agents, antibacterial and antifungal agents, insect repellents or skin conditioners.

The device may include a one-way air-intake valve allowing air to enter the container in the event of a depression in the latter.

Advantageously, when the volume of the internal space is equal to the first volume, the internal space is at atmospheric pressure.

The subject of the invention is also a method for filling an application element with product, this product being contained in an internal space of a container, this internal space containing a substantial amount of air above the product, this method being characterized in that it comprises the steps consisting in:

- placing the application element in a housing at least partly bounded by a first face of a permeable wall;
- bringing the product into contact with a second face of the permeable wall, on the opposite side from the first, by shaking the container or placing it upside-down;
- temporarily creating an overpressure in the said internal space, the permeable wall and the container both being designed in such a way that the said overpressure moves the product present in contact with the second face, or in its vicinity, towards the first face; and
- removing the application element from the housing.

The fact of having created an overpressure at the time of use makes it possible to produce the permeable wall in such a way that the product does not pass easily through the latter solely by the action of gravity, for example.

Thus, the risk of product being lost, by accidentally turning the device upside down for example, is reduced.

It is possible, in particular, to select the size of the passages in the permeable wall depending on the Theological properties of the product, especially its viscosity, in such a way that an overpressure has to be exerted in order for a sufficient amount of product to pass through the permeable wall.

Preferably, the inside of the container is at atmospheric pressure before the said overpressure is created.

The subject of the invention is also the use of a device as mentioned above for applying a product to one's body or one's face, the application element and the permeable wall both being sized accordingly.

The subject of the invention is also the use of a device as mentioned above in the hair-treatment, dermatological or cosmetic fields.

The invention will be more clearly understood on reading the following detailed description of non-limiting embodiments and on examining the appended drawing, in which.

Figure 1:
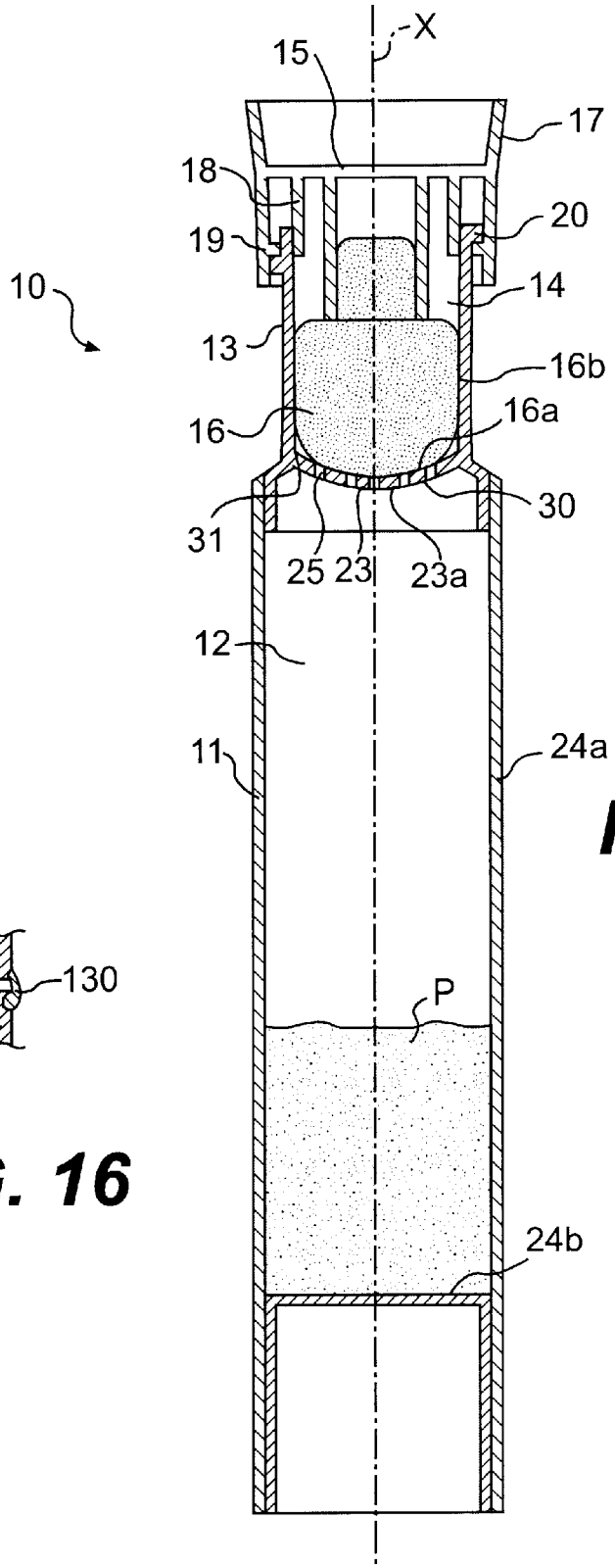
FIG. 1 is a schematic view in axial cross section of a device according to a first embodiment of the invention.

The packaging and application device 10 shown in FIG. 1 comprises a container 11 having a shape-memory flexible tubular body 24*a*, of axis X, defining an internal space 12 containing a reserve of product P.

The product P is, for example, a powder such as a foundation, composed of pigment particles coated with a binder.

The product P may also consist of a composition comprising particles containing at least one fluid.

In particular, the product P may, for example, be a "liquid powder" which includes: a) a "dry" or "pulverulent" phase optionally comprising a binder and generally based on pigments and/or nacres and/or fillers and/or flakes, and/or mixtures thereof, and b) a "liquid" phase able especially to act as a binder phase and containing, inside microcapsules, vesicles, microsponges, porous waxes or any other structure capable of storing a fluid and of releasing it, especially in response to a pressure, a liquid such as water, propylene glycol, oil, a gel or else an oil-in-water or water-in-oil emulsion.

At application, by spreading and pressing the powder against the skin, the liquid contained in the vesicles or microcapsules or the like is released, thereby producing a pleasant sensation of freshness.

The product P may comprise a pulverulent phase as a mixture with the "liquid" phase and able to be formed from pigments and/or nacres and/or fillers and/or flakes normally used in cosmetic compositions, and/or mixtures thereof.

The particles forming the pulverulent phase may furthermore be coated with a binder.

The term "pigments" should be understood to mean white or coloured, mineral or organic, particles insoluble in the medium and intended to colour and/or opacify the composition.

The pigments may be of the usual or nanometric size. Among mineral pigments and nanopigments, mention may be made of titanium, zirconium or cerium dioxides and zinc, iron or chromium oxide, titanium nanoparticles, zinc nanoparticles and ferric blue. Among organic pigments, mention may be made of carbon black and lacquers such as calcium, barium, aluminium or zirconium salts, acid dyes such as halo-acid, azo or anthraquinone dyes.

The pigments may especially be coated with silicone compounds such as polydimethylsiloxanes and/or by polymers, especially polyethylenes. Thus, mention may be made of the pigments SA or SI sold by Maprecos.

The term "fillers" should be understood to mean colourless or white, mineral or synthetic, lamellar or non-lamellar particles intended to give the composition body or stiffness and/or softness, flatness and uniformity when applying make-up.

The fillers may be of a mineral or synthetic, lamellar or non-lamellar, kind. Mention may be made of talc, mica, silica, kaolin, nylon, poly-β-alanine and polyethylene powders, Teflon, lauroyl lysine, starch, boron nitride, bismuth oxychloride, tetrafluoroethylene polymer powders, polymethylene methacrylate powders, polyurethane powders, polystyrene powders and polyester powders, synthetic hollow microspheres, such as EXPANCEL (Nobel Industries), microsponges, such as POLYTRAP (Dow Corning) and silicone resin microbeads, such as TOSPEARLS (Toshiba), zinc and titanium oxides, zirconium or cerium oxides, precipitated calcium carbonate, magnesium carbonate and hydrogencarbonate, hydroxyapatite, hollow silica microspheres, such as SILICA BEADS (Maprecos), glass or ceramic microcapsules and metal soaps derived from carboxylic organic acid having from 8 to 22 carbon atoms, preferably from 12 to 18 carbon atoms, for example zinc, magnesium or lithium stearate, zinc laurate and magnesium myristate.

The term "nacres" should be understood to mean iridescent particles which reflect light.

Among nacres that can be envisaged, mention may be made of natural nacre, mica covered with titanium oxide, with iron oxide, with natural pigments or with bismuth oxychloride, and also coloured titanium mica.

The compositions according to the invention may also include flakes.

The powder of the invention may furthermore include any additive normally used in the field in question, namely antioxidants, essential oils, preservatives, neutralizers, water-in-oil and oil-in-water surfactants, vitamins and anti-wrinkle active agents.

The fluid contained in the "liquid" phase may be in an aqueous or oily form, especially in the form of essential oils, of gel, especially cubic gel particles, of a water-in-oil (W/O) emulsion or an oil-in-water (O/W) emulsion.

The fluid may be contained in vesicles or microcapsules, the walls of which are especially made of epoxy, polyethylene, gelatin or polyester, or in microsponges or microspheres. The fluid may also be contained in porous waxes such as polyacrylates.

The fluid, especially when it is water, may be contained in an anhydrous structure of the type described in Patent Application EP-A-0,855,177.

Again by way of example, the "liquid" phase comprises an aqueous dispersion of vesicles which consist of a membrane of lipid phase encapsulating an aqueous phase. The vesicles that can be used may also be provided with a lamellar liquid-crystal coating.

Preferably, the composition contains at least one active agent. Such an active agent may be hydrophilic, lipophilic or a combination of the two.

Among the various active principles that can be incorporated, mention may especially be made of:

- antioxidants or free-radical scavengers, such as proteins and enzymes, lactoperoxydase and lactoferrin, peptides and their derivatives, sequestrants, flavonoids, chlorophyllin, ethoxyquin, guanosine, tocopherols and their derivatives, ascorbyl palmitate, β-carotene, vitamin E and its derivatives, vitamin C and its derivatives and vitamin A and its derivatives;
- hydrating or moisturizing agents such as hyaluronic acid and its sodium salt, β-glycerophosphate, glycerol, sorbitol and panthenol;
- UV screens such as the products sold under the names EUSOLEX 232® by Merck, PARSOL 1789® and PARSOL MCX® by Givaudan-Roure, MEXORYL SX® by Chimex and UNIVUL T150® by BASF;
- keratolitics such as proteolytic enzymes, salicylic acid and its derivatives, such as 5-(n-dodecanoyl)salicylic acid, and retinoic acid and its derivatives;
- tanning accelerators such as caffeine, and tyrosine derivatives such as glucose tyrosinate and the disodium salt of N-L-malyltyrosine;
- depigmentizing agents such as kojic acid, glycolic acid, vitamin C and especially magnesium ascorbyl phosphate, and arbutin and its derivatives;
- natural colorants such as colouring materials extracted from plants, such as chlorophyllin and β-carotene, or extracted from animals, such as cochineal carmine, and caramel;
- self-tanning agents, such as dihydroxyacetone and indoles;
- liporegulators, such as γ-octanoyl [lacuna], extract of *Centella asiatica* containing genin and asiatic acid, caffeine, and theophylline;
- anti-ageing and anti-wrinkle agents, such as hydroxyacids like glycolic acid, n-octanoylsalicylic acid, retinol and its derivatives, like retinol acetate, palmitate and propionate, and retinoids;
- anti-inflammatory and cicatrizing agents, such as 18β-glycyrrhetinic acid and its salts, especially its ammonium salt, α-bisabolol, corticoids, extract of *Centella asiatica,* aloe vera;
- antibacterial and antifungal agents, such as benzalconium chloride, chlorhexidin, hexetidin and hexamidin;
- insect repellents, such as diethyltoluamide and dimethyltoluamide;
- deodorants, such as hexachlorophene and triclosan produced and sold under the name IRGASAN DP 300® by Ciba-Geigy;
- skin conditioners, such as cationic polymers and cations.

By way of indication, the "liquid" phase may represent from 1 to 50%, preferably from 2 to 30% and more preferably from 5 to 20%, by weight of the composition.

Returning to the device 10 shown in FIG. 1, it may be seen that the body 24*a* is closed at the bottom by a solid bottom wall 24*b*.

The container 11 includes a neck 13 of axis X, consisting of an attached piece, the neck 13 defining a housing 14 intended to house an applicator 15 comprising an application element 16 and a gripping member 17, the latter also constituting a cap 13 for closing the neck 13.

The cap 17 includes a sealing skirt 18 which is applied so as to seal against the inner surface of the neck 13.

The cap 17 also has an outer skirt 19 provided with a thread suitable for engaging in a complementary thread 20 produced on the outer surface of the neck 13, in its upper part.

A permeable wall 23 separates the housing 14 from the internal space 12 containing the product P.

The amount of product contained in the container 11 is selected in such a way that a substantial amount of air is present in the container, above the product.

The internal space of the container containing the product is thus initially half-filled or three-quarter-filled, for example.

In the embodiment described, the permeable wall 23 is produced with the neck 13 as a single plastic moulding.

The permeable wall 23 has an inner face 30 turned towards the internal space 12 and an outer face 31 defining the bottom of the housing 14.

A plurality of openings 25, the diameter of which is of the order of one millimetre in the example described, are defined by a plurality of partitions 23*a* and pass through the permeable wall 23. Openings 25 are distributed uniformly over wall 23.

The application element 16 consists of a foam.

The front surface 16*a* of the application element 16, located opposite the outer face 31 of the permeable wall 23, rests in contact with the latter without appreciable axial compression.

The lateral surface 16*b* of the application element 16 rests against the side wall of the neck 13 and is compressed radially.

The surface 16*a* is able to move back away from the wall 23 due to the effect of an overpressure created in the container 11.

The operation of the device 10 will now be described with reference to FIGS. 12 to 15.

Figure 12:
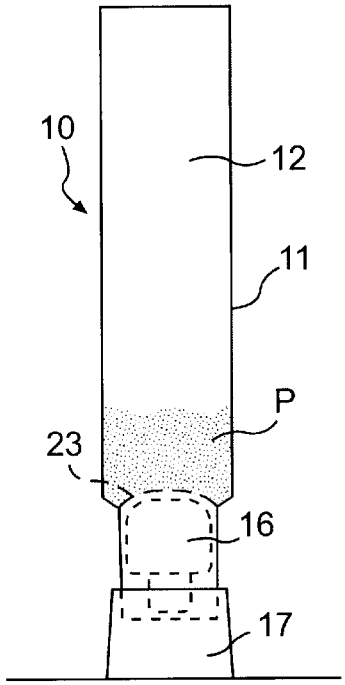
FIGS. 12 to 15 illustrate the use of the device of FIG. 1.

It is assumed that the container 11 is stored with its top down, that is to say the product P rests on the permeable wall 23, as illustrated in FIG. 12.

Figure 13:
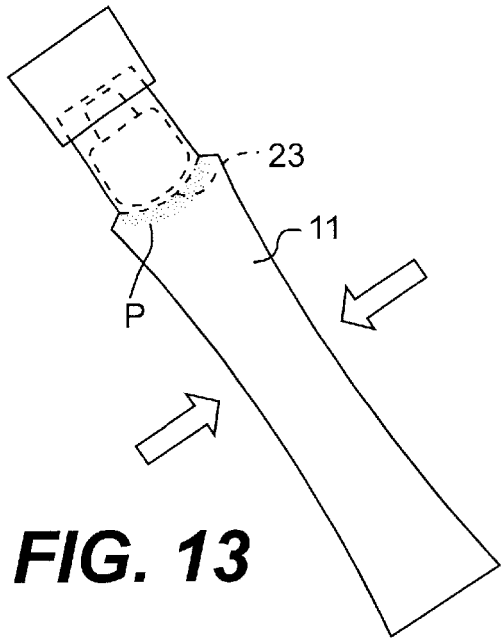

The user turns the container 11 over and compresses the flexible wall of the body 24*a*, as illustrated in FIG. 13, making the internal space 12 containing the product, initially at atmospheric pressure, pass from a first volume to a second volume, smaller than the first, thus creating an overpressure in this internal space 12.

When the user releases the pressure, the internal space returns to its initial volume, that is to say the first volume, because of the shape memory of the container.

Figure 15:
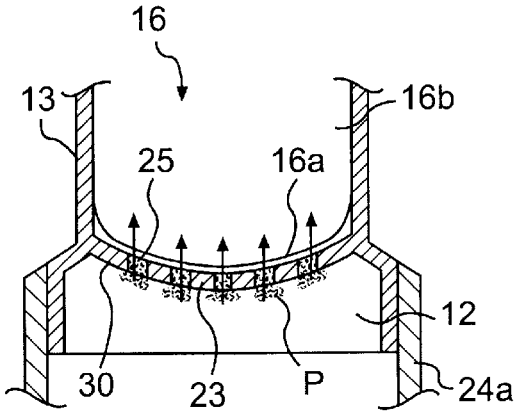

The product retained by the capillary effect and/or electrostatic attraction on the inner face 30 side of the permeable wall 23, and in the openings 25, is forced into the housing 14 in contact with the application element 16 due to the effect of the overpressure in the internal space 12, as illustrated by the arrows in FIG. 15.

Figure 14:
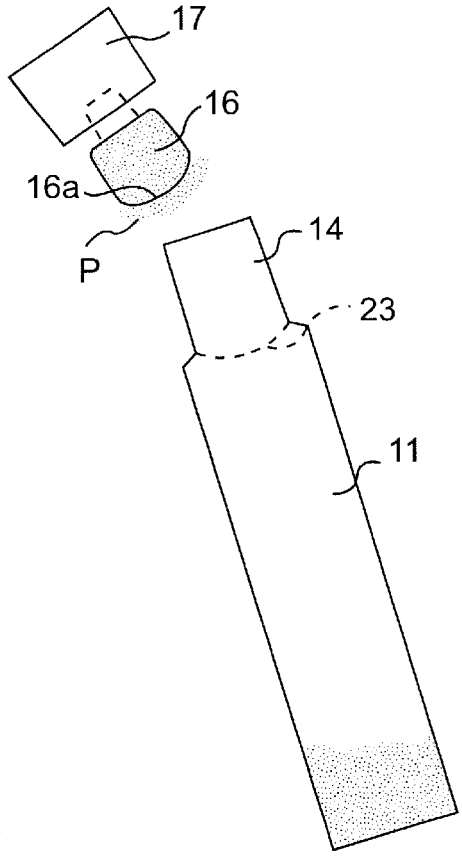

The application element 16 is thus charged with product and can then be removed for application, as illustrated in FIG. 14, the product being present on its front face 16*a*.

If the container 11 is not stored with the top down, the user can bring the product into contact with the inner face 30 of the permeable wall by shaking the container.

Product is then deposited on the permeable wall 23 which can retain a certain amount of product by capillary effect and/or by electrostatic attraction.

The overpressure which is then created is conducive to transferring the product from the inner face 30 to the outer face 31, in order to charge the application element 16.

It will be noted in the example described that a slight depression is created in the housing 4 when removing the application element 16, because of the fact that the lateral surface 16*b* of the latter is applied against the side wall of the neck 13.

The overpressure may be created in the internal space containing the product by various means.

Figure 2:
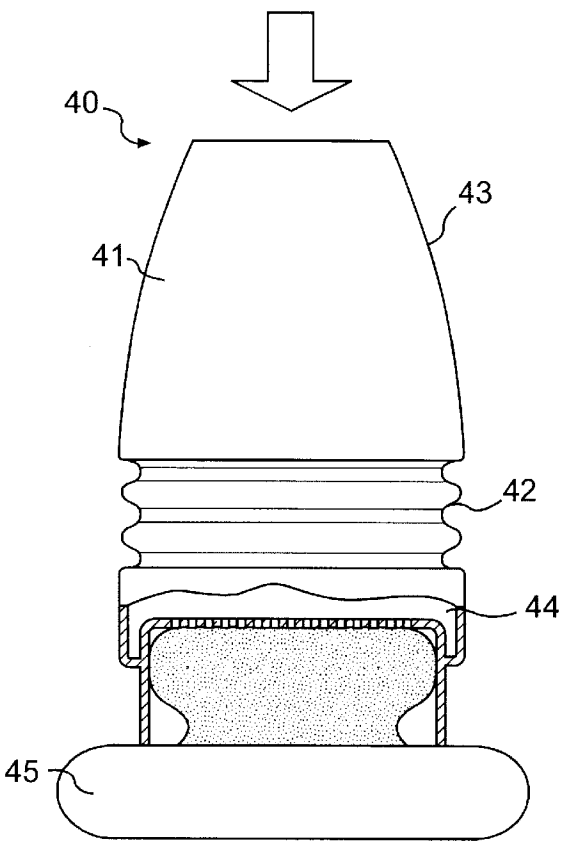

By way of example, FIG. 2 shows a device 40 in which the product is contained in a container 41.

The latter has a deformable part 42 in the form of a bellows, which part joins the upper part 43 and the lower part 44 of the container.

In order to create an overpressure in the internal space containing the product, the user presses on the upper part 43 while the device rests, top down, via the gripping element 45 of the applicator on a bearing surface, as illustrated.

Figure 3:
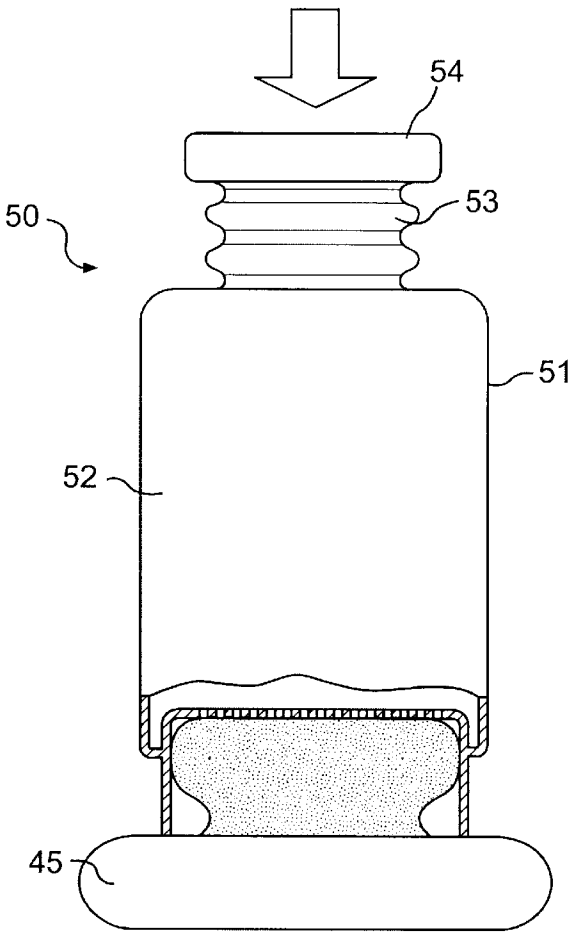
FIGS. 2 to 5 illustrate alternative embodiments of the container.

FIG. 3 shows a device 50 in which the container 51 has a substantially non-deformable body 52 provided in the upper part with a pusher 54 joined to the body 52 via a bellows 53.

This bellows may be produced as a single piece with the body 52 or it consists of an attached piece.

In order to exert the overpressure, the user presses on the pusher 54 while the container 51 is resting, top down, via the gripping element 45 of the applicator, thereby folding up the bellows 53.

Figure 4:
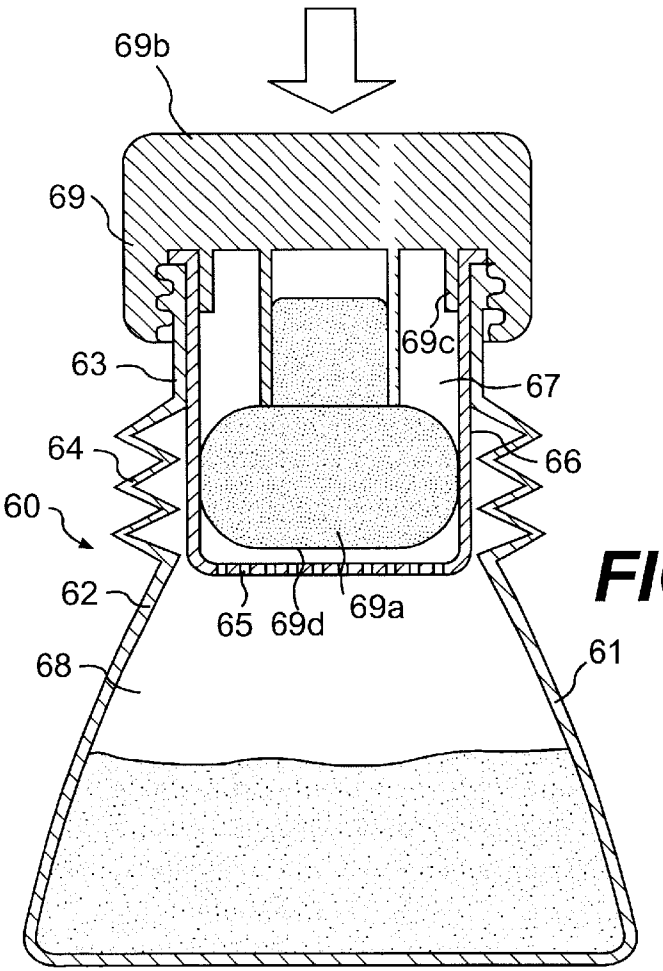

The device 60 shown in FIG. 4 includes a container 61 comprising a body 62 and a neck 63 joined to the body 62 via a deformable part 64 in the form of a bellows.

An insert 66 having the general shape of a thimble is mounted in the neck 63 in order to define a housing 67 for housing an applicator 69.

This applicator comprises an application element 69*a* and a closure cap 69*b* which also constitutes a gripping element.

The cap 69*b* has an inner sealing skirt 69*c* capable of being applied in a sealed manner against the inner surface of the insert 66 in order to seal the container, the insert 66 itself being engaged in a sealed manner in the upper part of the neck 63.

A substantially plane permeable wall 65 is produced in the bottom of the insert 66 in the form of a mesh.

The front face 69*d* of the application element 69*a* may not be in contact with the permeable wall 65, as shown.

The front face 69*a* can move back under the effect of an overpressure in the container 61, thereby promoting good distribution of the product on the surface of the application element.

To create the overpressure in the internal space 68 containing the product, the user presses on the cap 69*b*, thereby folding up the bellows-shaped part 64 on itself.

Figure 5:
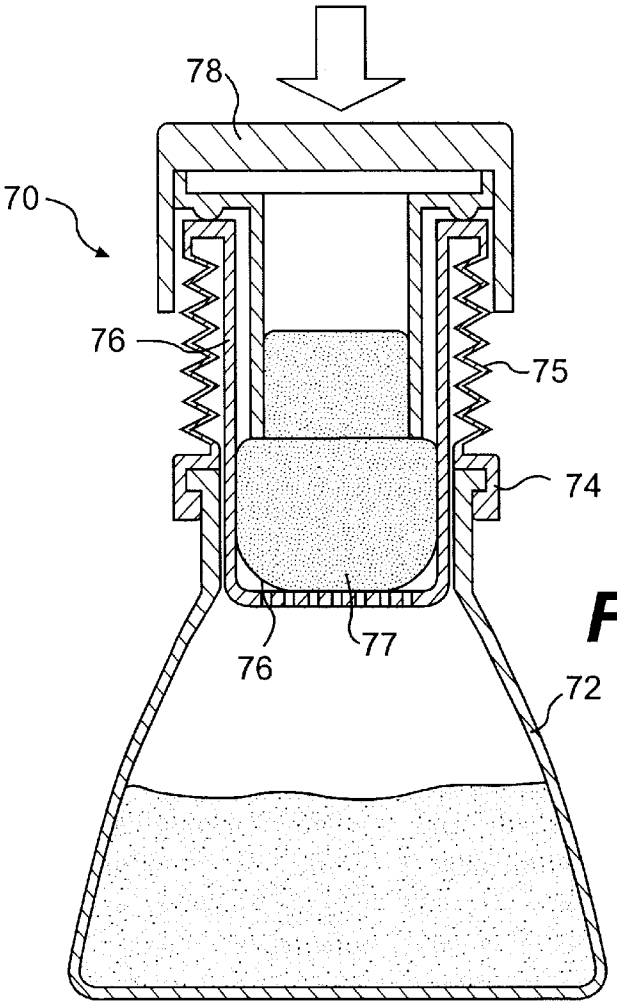

The device 70 shown in FIG. 5 comprises a container 72 on the neck 74 of which a receiving head of the applicator is fitted, this receiving head comprising an external bellows 75 and an internal part 76 able to house an application element 77.

To create the overpressure, the user presses on the closure cap 78, which compresses the bellows 75 and lowers the internal part 76 into the container 72.

The use of an insert, such as the insert 66, is advantageous since various inserts can be readily fitted onto the same type of container, depending on the nature of the product to be dispensed and of the application element.

The insert may be formed in various ways, the permeable wall possibly consisting, inter alia, of a woven, a perforated plastic film or a welded or over-moulded screen.

Figure 6:
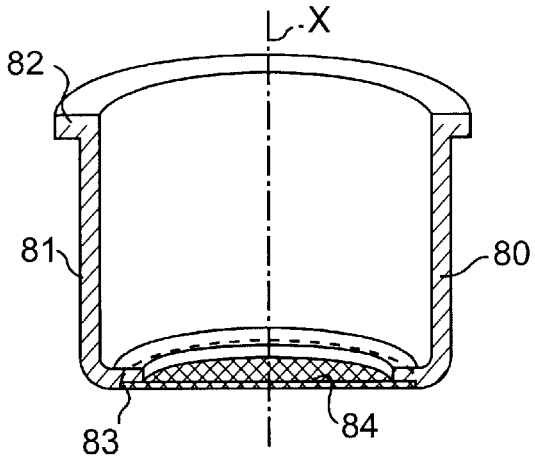
FIGS. 6 to 9 illustrate embodiments of the permeable wall.

By way of example, FIG. 6 shows an insert 80 having an axisymmetric cylindrical side wall 81, of axis X, provided at its upper end with a rim 82 facing outwards, serving for fastening to the container, and at its lower end with an annular rim 83, facing inwards, serving for fastening a screen 84 fastened to the lower face of the rim 83.

Figure 7:
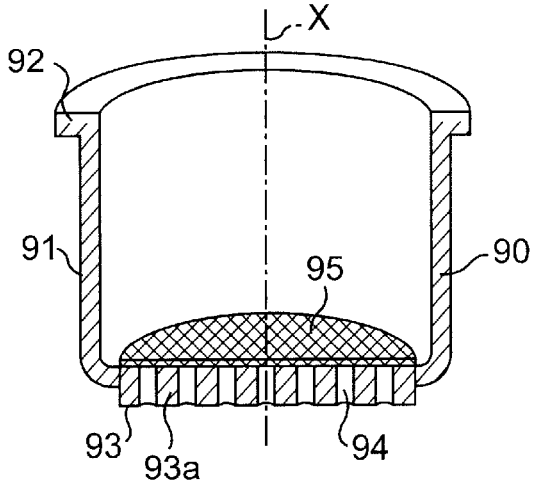

In the example in FIG. 7, the insert 90 has an axisymmetric side wall 91, of axis X, provided at its upper end with an annular rim 92 facing outwards, serving for fastening to the neck of the container, and at its end with a perforated bottom 93, this bottom being penetrated by a plurality of openings 94 defined by partitions 93*a*.

A screen 95 is attached to the bottom wall 93.

The mesh cells of the screen 95 have a smaller cross section than that of the openings 94 in the wall 93.

The wall 93 serves both as a mechanical support for the screen 95 and promotes the accumulation of product in contact with this screen 95 or in its vicinity, so that when the overpressure is created in the internal space containing the product, the product present in the openings 94 is forced out through the screen 95.

Figure 8:
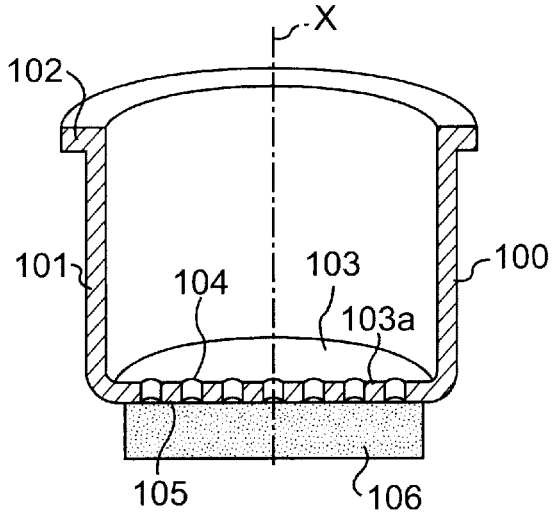

The insert 100 shown in FIG. 8 has an axisymmetric side wall 101 of axis X, extended outwards at its upper end by an annular rim 102 serving for fastening to the container and closed at its lower end by a bottom wall 103 having openings 104 defined by partitions 103*a*.

So as to promote retention of the product in contact with the lower face 105 of the bottom wall 103, an element such as a layer of open-cell foam 106 having large cells is attached to the insert 100 below the bottom wall 103.

Figure 9:
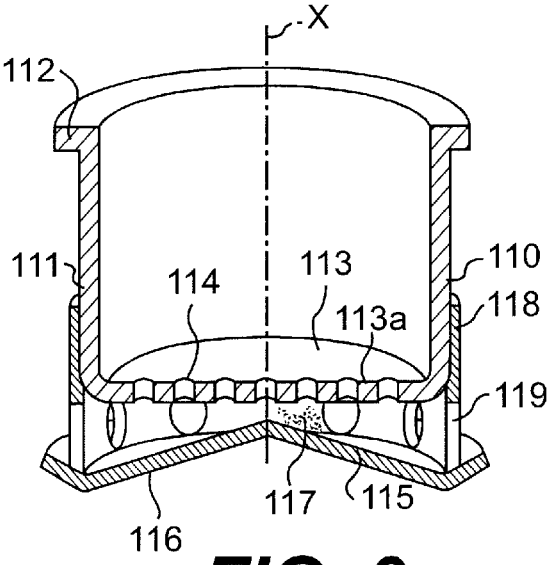

In the example in FIG. 9, the insert 110 has a side wall 111 which is axisymmetric with respect to the axis X, having an annular rim 112 in the upper part and an apertured bottom wall 113. Wall 113 has a plurality of openings 114 defined by partitions 113*a*.

A retention member 115 is secured to the insert, this retention member having a solid wall 116 placed beneath the bottom wall 113 and providing, with the latter, a space 117 in which the product can be retained.

The retention member 115 has a side wall 118 fixed to the side wall 111 of the insert and provided with lateral openings 119 allowing product to reach the aforementioned space 117.

The wall 116 has an approximately conical shape so that the height of the space 117 progressively decreases on approaching the X axis.

The retention member also acts as a deflector, guiding the flow of air into the space 117.

Of course, the invention is not limited to the embodiments that have just been described.

In particular, the overpressure inside the internal space containing the product may be created in a way other than by deforming a flexible wall of the container.

Figure 10:
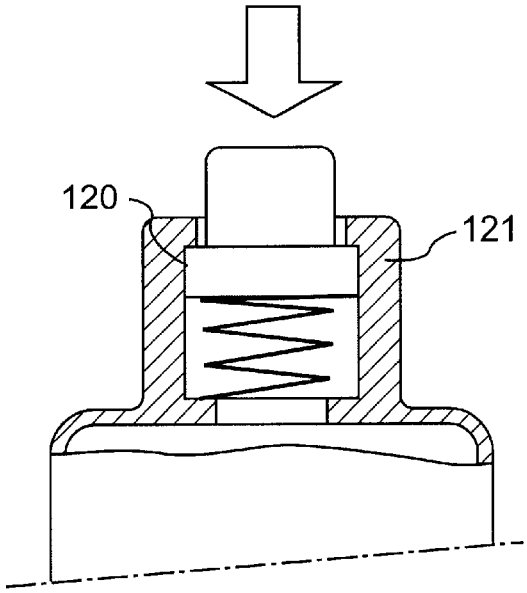
FIG. 10 illustrates an embodiment of means allowing the overpressure to be created in the container.

Thus, as illustrated in FIG. 10, it is possible to use, for example, a piston 120 mounted so as to slide in a duct 121 of the container.

Figure 11:
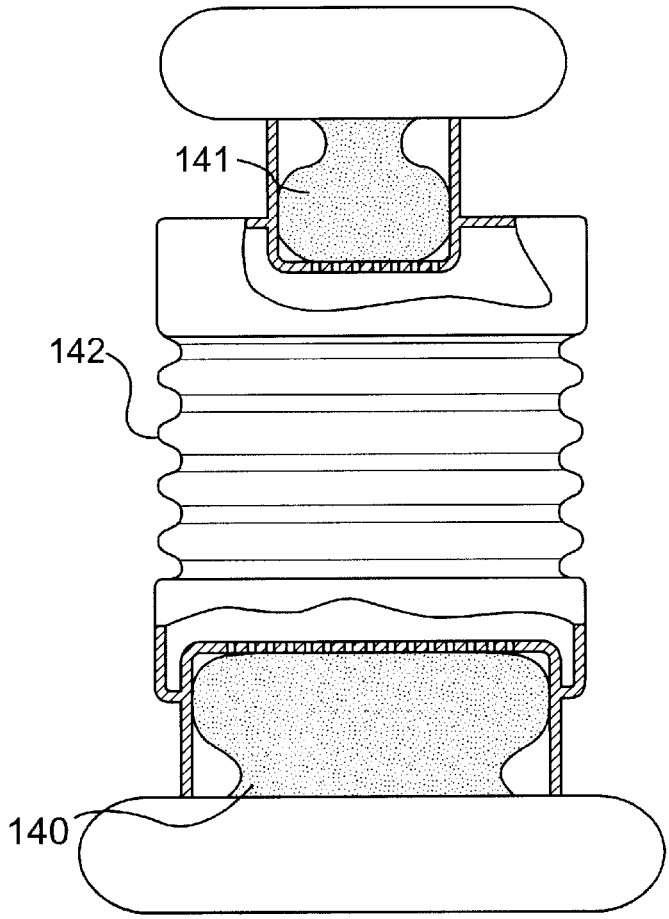
FIG. 11 shows a device having two application elements.

It is possible, without departing from the scope of the present invention, to produce a packaging and application device comprising two applicators, each having one application element housed in a housing whose bottom consists of a permeable wall, as illustrated in FIG. 11.

FIG. 11 shows that the two application elements 140, 141 may be of the same kind, but of different size.

Furthermore, FIG. 11 shows that the reduction in volume of the container may be effected by means of a bellows 142, located between the two housings which house the two application elements 140 and 141.

Figure 20:
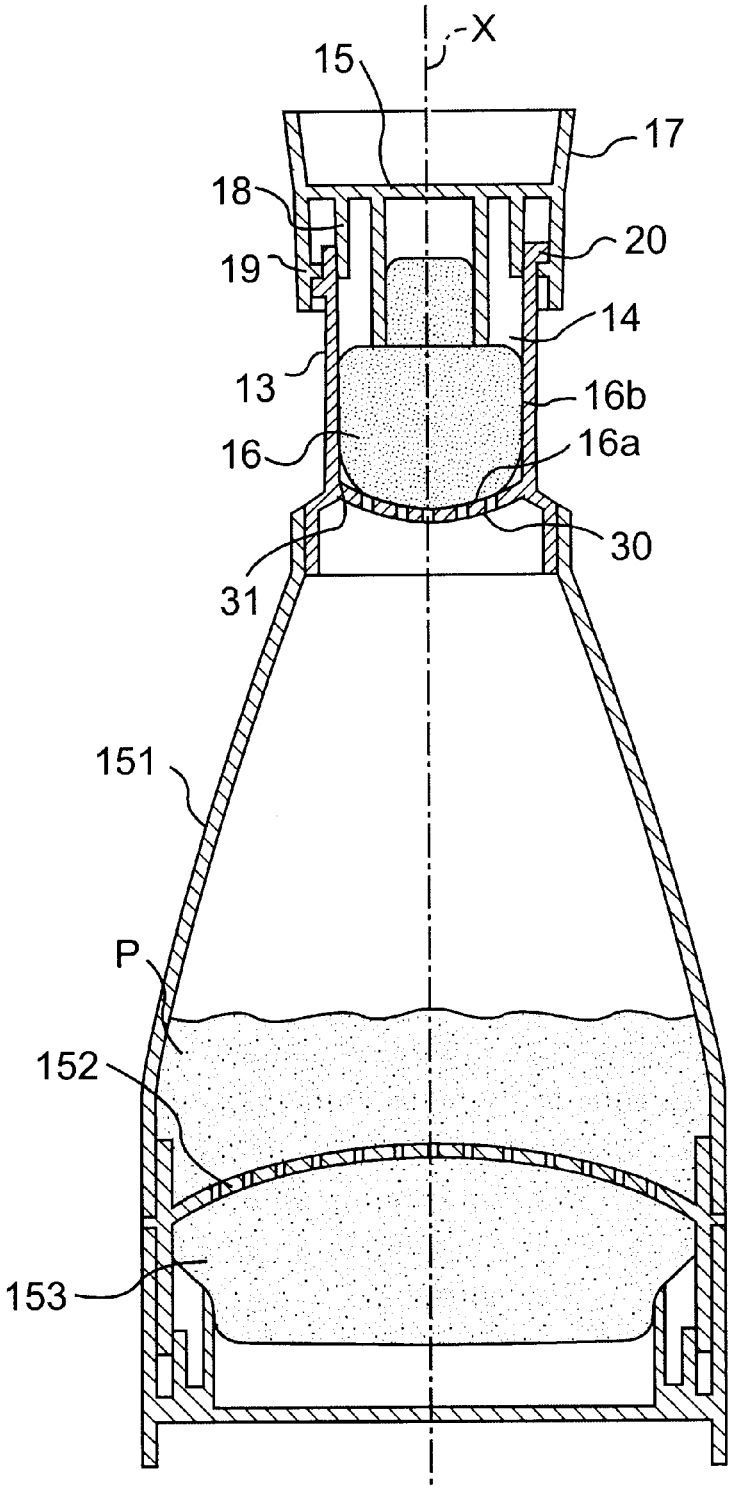
FIG. 20 shows a device comprising two application elements, forming an alternative embodiment of the device of FIG. 11.

The reduction in the internal volume of the container could also be effected other than by means of a bellows, as illustrated in FIG. 20.

This figure shows a device which has an upper part identical to that of the device shown in FIG. 1, a container comprising a body 151 which widens downwards, having in the lower part a permeable wall 152 leading to a housing containing a second application element 153.

The latter is fitted onto the container 151 in a similar manner to the first application element 16.

The reduction in the internal volume is effected by exerting lateral pressure on the container 151, the latter having shape memory.

Figure 17:
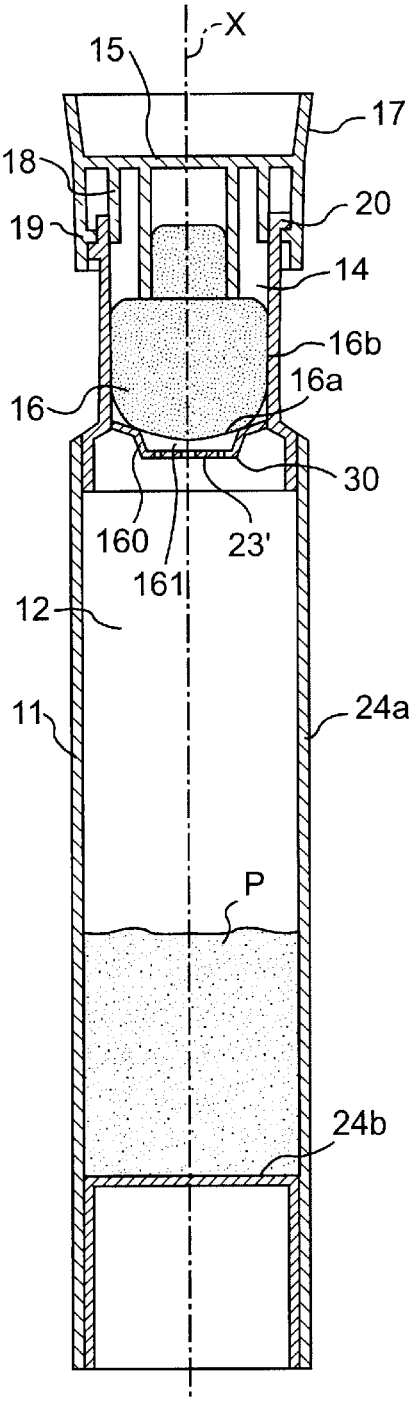
FIG. 17 shows an alternative embodiment of the permeable wall.

To promote the accumulation of product in the vicinity of the application element, the permeable wall may include a shoulder 160, as illustrated in FIG. 17.

This figure shows that the permeable wall, referenced 23', forms, by virtue of the shoulder 160, a space 161 in which the product P can accumulate.

Figure 18:
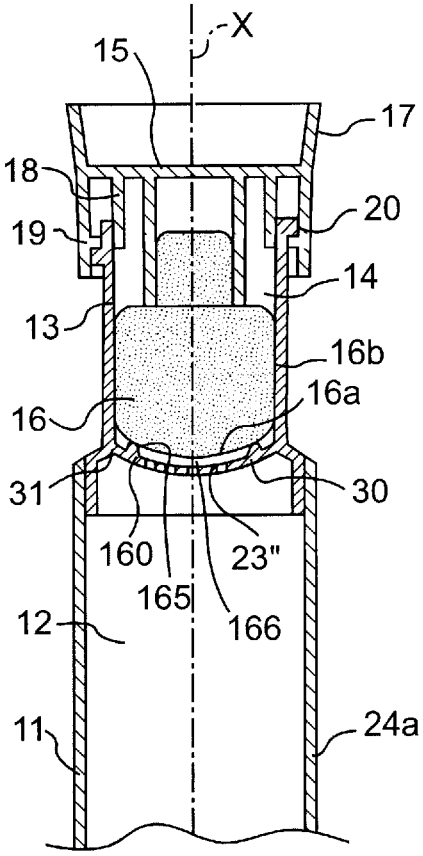
FIG. 18 illustrates the formation of ribs on the permeable wall.

The permeable wall may also include, as illustrated in FIG. 18, one or more ribs on its outer face, these being capable of coming into contact with the front face of the application element.

FIG. 18 shows a permeable wall 23" which differs from the wall 23 described above by the presence on the outer face 31 of an annular rib 165 surrounding an apertured central region.

The application element 16 bears on this rib 165, thereby creating a space 166 between the permeable wall 23" and the application element 16, into which space the product can accumulate.

Figure 19:
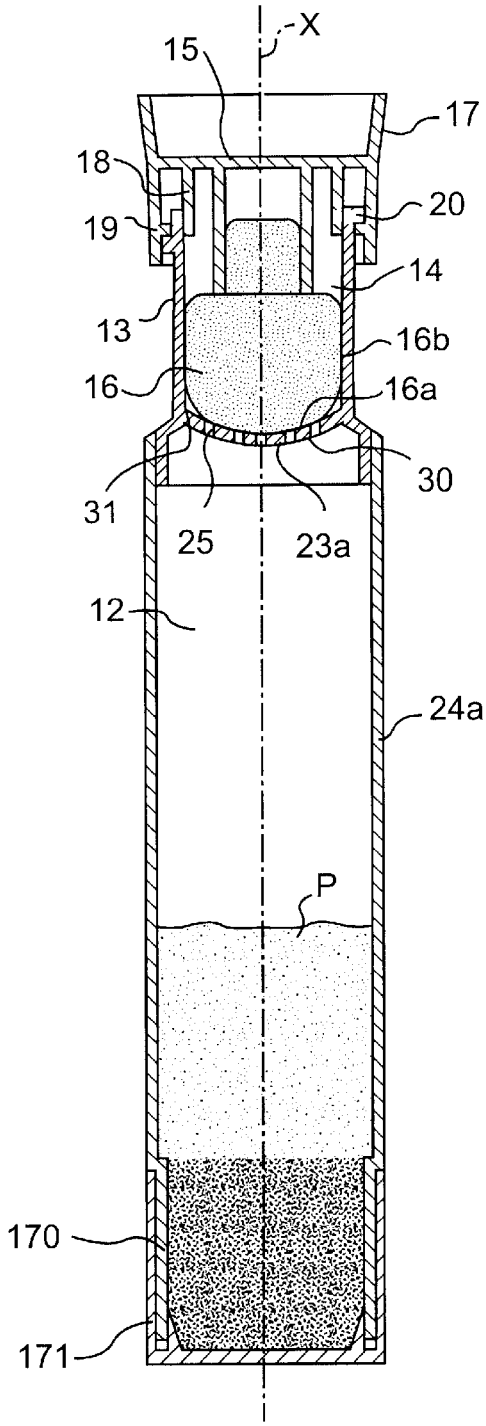
FIG. 19 illustrates the formation of a second opening in the container.

The container may be produced with a bottom provided with a neck 170, as shown in FIG. 19.

This neck 170 may or may not be threaded and it is closed by a removeable stopper 171.

The user can remove the stopper 171 in order to gain direct access to the product P contained inside the container, should this be necessary, the product then being removed, for example by means of a finger, or an applicator such as a brush or the like (not shown).

The device may have two application elements, as already described with reference to FIGS. 11 and 20.

These two application elements may be of different types.

Figure 21:
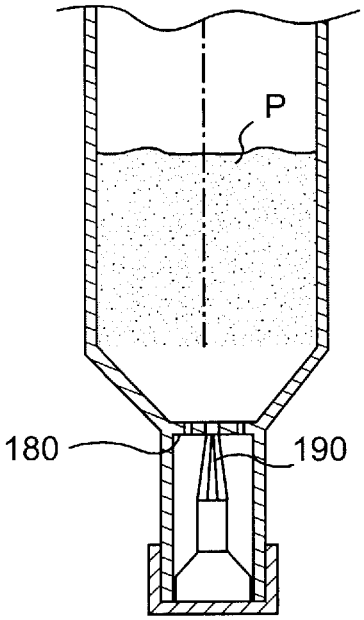
FIG. 21 illustrates the use of two application elements of different type.

By way of example, FIG. 21 shows a container which has, in the lower part, a permeable wall 180 leading to a housing containing an application element 190, such as a brush.

The device may include a one-way air-intake valve allowing air to be taken into the container, when the application element is in place.

Figure 16:
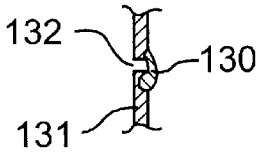
FIG. 16 shows schematically an air-intake valve.

FIG. 16 shows, by way of entirely non-limiting example, an air-intake valve 130 mounted onto a wall 131 of the container so as, when not in use, to close off an orifice 132 via which the air can enter the container should a depression be created in the latter.

What is claimed is:

1. An application device comprising:

a container having an internal space configured to contain product;

product contained in the internal space of the container;

an application element;

a housing for housing the application element; and a permeable wall located between the housing and the internal space, wherein the application element and the housing are configured so that the application element, when in the housing, comprises at least one surface portion without appreciable axial compression, the at least one surface portion being opposite at least one opening in the permeable wall, wherein the internal space has a variable-volume, wherein the device is configured to reduce volume of the internal space from a first volume, greater than a volume of the product contained in the internal space, to a second volume, smaller than the first volume, wherein the reduction in volume is accompanied by an overpressure conducive to transferring product through the permeable wall towards the application element, and wherein before a first use of the device, the first volume of the internal space is greater than the volume of product.

2. The device of claim 1, wherein the device is configured so that the internal space substantially resumes the first volume due to elastic return.

3. The device of claim 2, wherein the container has shape memory providing the elastic return.

4. The device of claim 2, further comprising a spring providing the elastic return.

5. The device of claim 1, further comprising retention means on and/or adjacent to a side of the permeable wall facing the internal space, wherein theretention means is configured to retain product in or near the at least one opening, for transferring product into the housing during compression of a volume of air in the internal space.

6. The device of claim 5, wherein the retention means include partitions configured to retain product therebetween.

7. The device of claim 5, wherein the retention means includes a retention member located opposite the permeable wall, and the retention member has lateral openings configured to allow product to flow to a product retention space provided between the retention member and the permeable wall.

8. The device of claim 5, wherein the retention means is produced by moulding.

9. The device of claim 5, wherein the retention means comprises an attached piece.

10. The device of claim 9, wherein the attached piece is a block of foam.

11. The device of claim 5, wherein the retention means retains product in or near the at least one opening in the permeable wall by at least one of a capillary effect and electrostatic attraction.

12. The device of claim 1, wherein the container comprises a moveable wall configured to generate the overpressure.

13. The device of claim 12, wherein the moveable wall comprises a flexible wall of the container.

14. The device of claim 13, wherein the flexible wall is in the form of a bellows.

15. The device of claim 12, wherein the moveable wall comprises a rigid wall of a piston.

16. The device of claim 1, wherein the permeable wall comprises a plurality of through-orifices.

17. The device of claim 1, wherein the application element and the housing are configured so that, when the application element is in place in the housing, a portion of a surface of the application element configured for applying product is not in contact with the permeable wall.

18. The device of claim 17, wherein the permeable wall includes at least one rib located on a side of the permeable wall facing the application element, and the application element is configured to bear against the at least one rib.

19. The device of claim 17, wherein the permeable wall joins the container via a shoulder forming a cup on a side of the permeable wall facing the application element.

20. The device of claim 1, wherein the application element and the housing are configured so that, when the application element is in place in the housing, a surface of the application element configured for applying product is in contact with the permeable wall.

21. The device of claim 1, wherein the application element is configured so that, when the application element is in place in the housing, a portion of the surface of the application element located opposite the permeable wall can move back under effect of the overpressure in the container.

22. The device of claim 1, wherein the housing, is bounded by a side wall, and a periphery of the application element contacts the side wall.

23. The device of claim 22, wherein the application element contacts the side wall in a sealed manner.

24. The device of claim 1, wherein the application element behaves as a piston during its retraction in the housing.

25. The device of claim 1, wherein the container is configured so that when the internal space has its second volume and the container is in a substantially head-up position, a level of product in a bottom portion of the container does not reach the permeable wall.

26. The device of claim 1, wherein the permeable wall defines the bottom of the housing and the application element is configured to be introduced into the housing via an opening located on the axis of the container on an opposite side of the housing from the permeable wall.

27. The device of claim 1, wherein the permeable wall includes a plurality of channels, and a cross section and a length of the plurality of channels are configured to accommodate at least one of a predetermined amount of product and a predetermined amount of product flow through the plurality of channels.

28. The device of claim 1, wherein the application element is integral with a gripping element, the gripping element comprising a cap for closing the container.

29. The device of claim 28, wherein the gripping element includes sealing means for sealing the housing.

30. The device of claim 1, wherein the product comprises a powder.

31. The device of claim 1, wherein the product comprises a liquid.

32. The device of claim 1, wherein the product comprises at least one of a gel and a cream.

33. The device of claim 1, wherein the permeable wall is moulded with the container.

34. The device of claim 1, wherein the permeable wall comprises a piece attached to the container.

35. The device of claim 1, wherein the permeable wall comprises a mesh.

36. The device of claim 1, wherein the permeable wall comprises a foam.

37. The device of claim 1, wherein the permeable wall is one of substantially planar and concave towards an opening in the housing opposite the permeable wall.

38. The device of claim 1, wherein the permeable wall comprises a shape complementary to a shape of the application element.

39. The device of claim 1, wherein the permeable wall has one of substantially radial orifices and axial orifices.

40. The device of claim 1, wherein the permeable wall comprises at least one of a woven material, a perforated plastic film, a welded screen, and an overmoulded screen.

41. The device of claim 1, wherein the application element is absorbent.

42. The device of claim 41, wherein the application element comprises at least one of a foam material, a felt material, and a sintered material.

43. The device of claim 1, wherein the application element is elastically compressible.

44. The device of claim 1, wherein the application element comprises a non-porous internal portion.

45. The device of claim 1, wherein the application element is substantially incompressible.

46. The device of claim 1, wherein the application element has at least one of flocking and a textile on its surface.

47. The device of claim 1, wherein the housing is configured to be moveable with respect to the internal space.

48. The device of claim 1, further comprising a second application element, a second housing, and a second permeable wall.

49. The device of claim 48, wherein the second application element is substantially the same as the first application element, but of different size.

50. The device of claim 48, wherein the first application element and the second application element are not substantially the same.

51. The device of claim 1, wherein the container includes a neck closed off by a removable stopper located at an end of the container opposite the application element.

52. The device of claim 1, further comprising a one-way air-intake valve configured to allow air to enter the container.

53. The device of claim 1, wherein the permeable wall is immovably fixed around its periphery to the container.

54. The device of claim 1, wherein the product is at least partly formed from particles containing at least one fluid.

55. The device of claim 54, wherein the product further comprises a pulverulent phase as a mixture with the particles containing at least one fluid.

56. The device of claim 55, wherein the pulverulent phase comprises at least one of pigments, nacres, fillers, flakes, and mixtures thereof.

57. The device of claim 56, wherein the pigments comprise at least one of titanium dioxides, zirconium dioxides, cerium dioxides, zinc oxides, iron oxides, chromium oxides, titanium nanoparticles, zinc nanoparticles, ferric blue, carbon black, lacquers, acid dyes, pigments coated with silicone compounds, and/or pigments coated with polymers.

58. The device of claim 57, wherein the lacquers comprise at least one of calcium salts, barium salts, aluminum salts, and zirconium salts.

59. The device of claim 57, wherein the acid dyes comprise at least one of halo-acid dyes, azo dyes, and anthraquinone dyes.

60. The device of claim 57, wherein the silicone compounds comprise polydimethylsiloxanes.

61. The device of claim 57, wherein the polymers comprise polyethylenes.

62. The device of claim 56, wherein the fillers comprise at least one of talc, mica, silica, kaolin, nylon, poly-β-alanine powders, polyethylene powders, Teflon, lauroyl lysine, starch, boron nitride, bismuth oxychloride, tetrafluoroethylene polymer powders, polymethyl methacrylate powders, polyurethane powders, polystyrene powders, polyester powders, synthetic hollow microspheres, silicone-resin microbeads, silicone-resin microsponges, zinc oxides, titanium oxides, zirconium oxides, cerium oxides, precipitated calcium carbonate, magnesium carbonate, magnesium hydrogencarbonate, hydroxyapatite, hollow silica microspheres, glass microcapsules, ceramic microcapsules, and metal soaps derived from carboxylic organic acids having from 8 to 22 carbon atoms.

63. The device of claim 62, wherein the metal soaps are derived from carboxylic organic acids having 12 to 18 carbon atoms.

64. The device of claim 54, wherein the fluid contained in the particles is in one of aqueous form, oily form, the form of essential oils, the form of gel, the form of a water-in-oil emulsion, and the form of an oil-in-water emulsion.

65. The device of claim 54, wherein the fluid is contained in at least one of porous waxes, vesicles, microcapsules, microsponges, and microspheres.

66. The device of claim 65, wherein walls of the vesicles or the microcapsules comprise at least one of epoxy, polyethylene, gelatin, and polyester.

67. The device of claim 54, wherein the phase formed from the particles containing the fluid represents from 1 to 50% by weight of a composition of the product.

68. The device of claim 67, wherein the phase formed from the particles containing the fluid represents from 2 to 30% by weight of a composition of the product.

69. The device of claim 67, wherein the phase formed from the particles containing the fluid represents from 5 to 20% by weight of a composition of the product.

70. The device of claim 1, wherein the product contains at least one active agent comprising at least one of antioxidants, free-radical scavengers, hydrating agents, moisturizing agents, UV screens, keratolytics, tanning accelerators, depigmentizing agents, natural colorants, self-tanning agents, liporegulators, anti-ageing agents, anti-wrinkle agents, anti-inflammatory agents, cicatrizing agents, antibacterial agents, antifungal agents, insect repellents, and skin conditioners.

71. The device of claim 1, wherein the product is not a powder.

72. The device of claim 1, wherein the application element comprises a compressible material.

73. The device of claim 1, wherein the housing for housing the application element is partially defined by a lateral wall against which the application element contacts.

74. The device of claim 1, wherein the application element contacts the permeable wall when the application element is in the housing.

75. The device of claim 1, wherein the application element comprises a first part and a second part, the first part being located closer than the second part to the at least one surface portion and the second part having a smaller cross-sectional area than the first part.

76. The device of claim 1, wherein the application element has a free end surface comprising the at least one surface portion, the free end surface being at least partially curved.

77. The device of claim 1, wherein the product is a cosmetic product.

78. A method for charging an application element with product, the product comprising at least one of a powder, a liquid, a gel, and a cream and being contained in an internal space of a container, the internal space having, before a first use, a volume greater than a volume of the product, and containing an amount of air above the product, the method comprising:

placing the application element in a housing at least partly bounded by a first face of a permeable wall;

bringing the product into contact with a second face of the permeable wall, on a side opposite the first face, wherein bringing the product into contact comprises at least one of shaking the container and turning the container upside-down;

temporarily creating an overpressure in the internal space, wherein the permeable wall and the container are configured so that the overpressure moves product located near or in contact with the second face towards the first face and the application element; and removing the application element from the housing.

79. The method of claim 78, wherein the internal space of the container is at atmospheric pressure before the overpressure is created.

80. The method of claim 78, wherein the application element is at least partially charged with product while the housing is in a head-up position.

81. The method of claim 78, wherein the product is a cosmetic product.

82. A method for charging an application element with product, the product being contained in an internal space of a container, the internal space having, before a first use, a volume greater than a volume of the product, and containing an amount of air above the product, comprising:

placing the application element in a housing at least partly bounded by a first face of a permeable wall;

bringing the product into contact with a second face of the permeable wall, on a side opposite the first face;

creating an overpressure in the internal space, wherein the overpressure moves product located near or in contact with the second face towards the first face and the application element; and removing the application element from the housing.

83. The method of claim 82, wherein the internal space of the container is at atmospheric pressure before the overpressure is created.

84. The method of claim 82, wherein bringing the product into contact with the second face of the permeable wall comprises shaking the container.

85. The method of claim 82, wherein bringing the product into contact with the second face of the permeable wall comprises turning the container upside-down.

86. The method of claim 82, wherein creating an overpressure in the internal space comprises applying pressure to a deformable wall of the container.

87. The method of claim 82, wherein creating an overpressure in the internal space comprises compressing a bellows associated with the container.

88. The method of claim 82, wherein the product comprises at least one of a powder, a liquid, a gel, and a cream.

89. The method of claim 82, wherein the application element is at least partially charged with product while the housing is in a head-up position.

90. The method of claim 82, wherein the product is a cosmetic product.

91. An application device comprising:

a container having an internal space configured to contain product and having a variable volume;

an application element;

a housing for housing the application element;

a permeable wall, having at least one opening, located between the housing and the internal space; and retention means on and/or adjacent to a side of the permeable wall facing the internal space for retaining product in or near the at least one opening, wherein the device is configured to reduce volume of the internal space from a first volume, greater than a volume of product contained in the internal space, to a second volume, smaller than the first volume, and wherein the reduction in volume is accompanied by an overpressure conducive to transferring product through the permeable wall towards the application element.

92. The device of claim 91, wherein the retention means comprises partitions configured to retain product therebetween.

93. The device of claim 91, wherein the retention means comprises a retention member located opposite the permeable wall, and the retention member has lateral openings configured to allow product to flow to a product retention space provided between the retention member and the permeable wall.

94. The device of claim 91, wherein the retention means is produced by moulding.

95. The device of claim 91, wherein the retention means comprises an attached piece.

96. The device of claim 91, wherein the retention means retains product in or near the at least one opening in the permeable wall by at least one of a capillary effect and electrostatic attraction.

97. The device of claim 91, wherein the application element comprises a first part and a second part, the first part being located closer than the second part to a free end of the application element and the second part having a smaller cross-sectional area than the first part.

98. The device of claim 91, wherein the application element has a free end surface facing the permeable wall when the application element is in the housing, the free end surface being at least partially curved.

99. An application device comprising:

a container having an internal space configured to contain product and having a variable volume;

a first application element;

a second application element;

a first housing for housing the first application element;

a second housing for housing the second application element;

a first permeable wall located between the first housing and the internal space; and a second permeable wall located between the second housing and the internal space, wherein the device is configured to reduce volume of the internal space from a first volume, greater than a volume of product contained in the internal space, to a second volume, smaller than the first volume, and wherein the reduction in volume is accompanied by an overpressure conducive to transferring product through at least one of the permeable walls.

100. The device of claim 99, wherein the second application element is substantially the same as the first application element, but of different size.

101. The device of claim 99, wherein the first application element and the second application element are not substantially the same.

102. An application device comprising:

a container having an internal space configured to contain product and having a variable volume;

an application element;

a housing for housing the application element; and a permeable wall located between the housing and the internal space;

wherein the device is configured to reduce volume of the internal space from a first volume, greater than a volume of product contained in the internal space, to a second volume, smaller than the first volume, wherein the reduction in volume is accompanied by an overpressure conducive to transferring product through the permeable wall towards the application element, wherein the application element comprises an end surface facing the permeable wall when the application element is in the housing, and wherein the permeable wall is configured to provide a space between at least a portion of the permeable wall and at least a portion of the end face.

103. The device of claim 102, wherein the internal space of the container contains a cosmetic product.

104. A method for charging an application element with product, the product being contained in an internal space of a container, and the internal space having an amount of air above the product, comprising:

placing the application element in a housing at least partly bounded by a first face of a permeable wall;

bringing the product into contact with a second face of the permeable wall, on a side opposite the first face;

creating an overpressure in the internal space, wherein the overpressure moves product located near or in contact with the second face towards the first face and the application element; and removing the application element from the housing, wherein the product is not a powder.

105. The method of claim 104, wherein the product is a cosmetic product.

106. A method for charging an application element with product, the product being contained in an internal space of a container, and the internal space having an amount of air above the product, comprising:

placing the application element in a housing at least partly bounded by a first face of a permeable wall;

bringing the product into contact with a second face of the permeable wall, on a side opposite the first face;

creating an overpressure in the internal space, wherein the overpressure moves product located near or in contact with the second face towards the first face and the application element; and removing the application element from the housing, wherein the application element comprises a compressible material.

107. The method of claim 106, wherein the product is a cosmetic product.

108. A method for charging an application element with product, the product being contained in an internal space of a container, and the internal space having an amount of air above the product, comprising:

placing the application element in a housing at least partly bounded by a first face of a permeable wall;

bringing the product into contact with a second face of the permeable wall, on a side opposite the first face;

creating an overpressure in the internal space, wherein the overpressure moves product located near or in contact with the second face towards the first face and the application element; and removing the application element from the housing, wherein the application element and the permeable wall contact one another during the placing.

109. The method of claim 108, wherein the product is a cosmetic product. product.

110. A method for charging an application element with product, the product being contained in an internal space of a container, and the internal space having an amount of air above the product, comprising:

placing the application element in a housing at least partly bounded by a first face of a permeable wall;

bringing the product into contact with a second face of the permeable wall, on a side opposite the first face;

creating an overpressure in the internal space, wherein the overpressure moves product located near or in contact with the second face towards the first face and the application element; and removing the application element from the housing, wherein the application element is at least partially charged with product while the housing is in a head up position.

111. The method of claim 110, wherein the product is a cosmetic product.

112. An application device comprising:

a container having an internal space configured to contain product;

product contained in the internal space of the container;

an application element;

a housing for housing the application element; and a permeable wall located between the housing and the internal space, wherein the application element and the housing are configured so that the application element, when in the housing, comprises at least one surface portion without appreciable axial compression, the at least one surface portion being opposite at least one opening in the permeable wall, wherein the internal space has a variable-volume, wherein the device is configured to reduce volume of the internal space from a first volume, greater than a volume of the product contained in the internal space, to a second volume, smaller than the first volume, wherein the reduction in volume is accompanied by an overpressure conducive to transferring product through the permeable wall towards the application element, and wherein the product is a liquid.

113. The device of claim 112, wherein the application element comprises a first part and a second part, the first part being located closer than the second part to the at least one surface portion and the second part having a smaller cross-sectional area than the first part.

114. The device of claim 112, wherein the application element has a free end surface comprising the at least one surface portion, the free end surface being at least partially curved.

115. The device of claim 112, wherein the product is a cosmetic product.

116. An application device comprising:

a container having an internal space configured to contain product;

product contained in the internal space of the container;

an application element;

a housing for housing the application element; and a permeable wall located between the housing and the internal space, wherein the application element and the housing are configured so that the application element, when in the housing, comprises at least one surface portion without appreciable axial compression, the at least one surface portion being opposite at least one opening in the permeable wall, wherein the internal space has a variable-volume, wherein the device is configured to reduce volume of the internal space from a first volume, greater than a volume of the product contained in the internal space, to a second volume, smaller than the first volume, wherein the reduction in volume is accompanied by an overpressure conducive to transferring product through the permeable wall towards the application element, wherein the device is configured to increase the volume of the internal space to substantially the first volume, after the reduction in volume, and wherein the product is not a powder.

117. The device of claim 116, wherein the device is configured so that the volume of the internal space increases to substantially the first volume due to elastic return.

118. The device of claim 117, wherein the container has shape memory providing the elastic return.

119. The device of claim 117, further comprising a spring providing the elastic return.

120. The device of claim 116, wherein the application element comprises a first part and a second part, the first part being located closer than the second part to the at least one surface portion and the second part having a smaller cross-sectional area than the first part.

121. The device of claim 116, wherein the application element has a free end surface comprising the at least one surface portion, the free end surface being at least partially curved.

122. The device of claim 116, wherein the product is a cosmetic product.

123. An application device comprising:

a container having an internal space configured to contain product;

an application element;

a housing for housing the application element; and a permeable wall located between the housing and the internal space, wherein the application element and the housing are configured so that the application element, when in the housing, comprises at least one surface portion without appreciable axial compression, the at least one surface portion being opposite at least one opening in the permeable wall, wherein the internal space has a variable-volume, wherein the device is configured to reduce volume of the internal space from a first volume, greater than a volume of the product contained in the internal space, to a second volume, smaller than the first volume, wherein the reduction in volume is accompanied by an overpressure conducive to transferring product through the permeable wall towards the application element, wherein the device is configured to increase the volume of the internal space to substantially the first volume, after the reduction in volume, and wherein the application element comprises a compressible material.

124. The device of claim 123, wherein the device is configured so that the volume of the internal space increases to substantially the first volume due to elastic return.

125. The device of claim 124, wherein the container has shape memory providing the elastic return.

126. The device of claim 124, further comprising a spring providing the elastic return.

127. The device of claim 123, wherein the application element comprises a first part and a second part, the first part being located closer than the second part to the at least one surface portion and the second part having a smaller cross-sectional area than the first part.

128. The device of claim 123, wherein the application element has a free end surface comprising the at least one surface portion, the free end surface being at least partially curved.

129. An application device comprising:

a container having an internal space configured to contain product;

an application element;

a housing for housing the application element; and a permeable wall located between the housing and the internal space, wherein the application element and the housing are configured so that the application element, when in the housing, comprises at least one surface portion without appreciable axial compression, the at least one surface portion being opposite at least one opening in the permeable wall, wherein the internal space has a variable-volume, wherein the device is configured to reduce volume of the internal space from a first volume, greater than a volume of the product contained in the internal space, to a second volume, smaller than the first volume, wherein the reduction in volume is accompanied by an overpressure conducive to transferring product through the permeable wall towards the application element, wherein the device is configured to increase the volume of the internal space to substantially the first volume, after the reduction in volume, and wherein the housing for housing the application element is partially defined by a lateral wall against which the application element contacts.

130. The device of claim 129, wherein the device is configured so that the volume of the internal space increases to substantially the first volume due to elastic return.

131. The device of claim 130, wherein the container has shape memory providing the elastic return.

132. The device of claim 130, further comprising a spring providing the elastic return.

133. The device of claim 129, wherein the application element comprises a first part and a second part, the first part being located closer than the second part to the at least one surface portion and the second part having a smaller cross-sectional area than the first part.

134. The device of claim 129, wherein the application element has a free end surface comprising the at least one surface portion, the free end surface being at least partially curved.

135. The device of claim 129, wherein the internal space of the container contains a cosmetic product.

136. An application device comprising:

a container having an internal space configured to contain product;

an application element;

a housing for housing the application element; and a permeable wall located between the housing and the internal space, wherein the application element and the housing are configured so that the application element, when in the housing, comprises at least one surface portion without appreciable axial compression, the at least one surface portion being opposite at least one opening in the permeable wall, wherein the internal space has a variable-volume, wherein the device is configured to reduce volume of the internal space from a first volume, greater than a volume of the product contained in the internal space, to a second volume, smaller than the first volume, wherein the reduction in volume is accompanied by an overpressure conducive to transferring product through the permeable wall towards the application element, wherein the device is configured to increase the volume of the internal space to substantially the first volume, after the reduction in volume, and wherein the application element contacts the permeable wall when the application element is in the housing.

137. The device of claim 136, wherein the device is configured so that the volume of the internal space increases to substantially the first volume due to elastic return.

138. The device of claim 137, wherein the container has shape memory providing the elastic return.

139. The device of claim 137, further comprising a spring providing the elastic return.

140. The device of claim 136, wherein the application element comprises a first part and a second part, the first part being located closer than the second part to the at least one surface portion and the second part having a smaller cross-sectional area than the first part.

141. The device of claim 136, wherein the application element has a free end surface comprising the at least one surface portion, the free end surface being at least partially curved.

* * * * *

UNITED STATES PATENT AND TRADEMARK OFFICE

CERTIFICATE OF CORRECTION

PATENT NO. : 6,945,723 B1
DATED : September 20, 2005
INVENTOR(S) : Jean-Louis H. Gueret It is certified that error appears in the above-identified patent and that said Letters Patent is hereby corrected as shown below:

Column 13,
Line 11, “theretention” should read -- the retention --.

Column 19,
Line 45, “product. product.” should read -- product. --.

Signed and Sealed this

Twenty-seventh Day of December, 2005

JON W. DUDAS
*Director of the United States Patent and Trademark Office*